United States Patent [19]

Baltz et al.

[11] Patent Number: 4,576,270

[45] Date of Patent: Mar. 18, 1986

[54] TORQUE CONTROL AND FLUID SHUTOFF MECHANISM FOR A FLUID OPERATED TOOL

[75] Inventors: James P. Baltz; Richard E. Plouck, both of Bryan, Ohio

[73] Assignee: The Aro Corporation, Bryan, Ohio

[21] Appl. No.: 470,509

[22] Filed: Feb. 28, 1983

[51] Int. Cl.[4] ..... B25B 23/145

[52] U.S. Cl. ..... 192/150; 173/12

[58] Field of Search ..... 192/0.034, 150; 173/12; 91/59

[56] References Cited

U.S. PATENT DOCUMENTS

| | | | |
|---|---|---|---|
| Re. 27,550 | 1/1973 | Bangerter | 192/0.034 |
| 2,986,052 | 5/1961 | Eckman et al. . | |
| 3,262,536 | 7/1966 | Frisbie et al. | 192/150 |
| 3,275,116 | 9/1966 | Martin | 192/150 |
| 3,288,258 | 11/1966 | Taylor | 192/150 |
| 3,289,715 | 12/1966 | De Groff et al. . | |
| 3,373,824 | 3/1968 | Whitehouse | 173/12 |
| 3,398,611 | 8/1968 | Hahner | 173/12 X |
| 3,400,633 | 9/1968 | Amtsberg et al. . | |
| 3,407,883 | 10/1968 | Amtsberg et al. | 173/12 |
| 3,442,177 | 5/1969 | Ulbing et al. . | |
| 3,473,439 | 10/1969 | Bratt . | |
| 3,477,521 | 11/1969 | Kiester et al. | 91/59 X |
| 3,498,389 | 3/1970 | Tibbott | 173/12 |
| 3,505,928 | 4/1970 | Whitehouse . | |
| 3,512,590 | 5/1970 | Tibbott | 173/12 |
| 3,512,591 | 5/1970 | Kulman | 173/12 |
| 3,515,225 | 6/1970 | States | 173/12 |
| 3,515,251 | 6/1970 | Clapp | 192/150 |
| 3,593,830 | 7/1971 | Clapp et al. | 192/150 |
| 3,596,542 | 8/1971 | Wallace . | |
| 3,613,751 | 10/1971 | Juhasz | 192/150 X |
| 3,616,864 | 11/1971 | Sorensen et al. | 192/150 |
| 3,642,039 | 2/1972 | McGee . | |
| 3,693,381 | 9/1972 | McGee | 192/150 X |
| 3,766,990 | 10/1973 | Eckman et al. | 173/12 |
| 3,811,513 | 5/1974 | Wezel et al. | 173/12 |
| 3,970,151 | 7/1976 | Workman, Jr. | 173/12 |
| 3,993,145 | 11/1976 | Findeli | 192/150 X |
| 4,006,785 | 2/1977 | Roll et al. | 192/150 X |
| 4,049,104 | 9/1977 | Webb | 192/150 |
| 4,071,092 | 1/1978 | Wallace | 173/12 |
| 4,078,618 | 3/1978 | DePagter et al. | 173/12 |
| 4,088,197 | 5/1978 | Roll et al. | 173/12 |
| 4,108,252 | 8/1978 | Stroezel | 173/12 |
| 4,113,080 | 9/1978 | Thackston et al. | 192/150 |
| 4,120,604 | 10/1978 | Garofalo | 173/12 X |
| 4,154,308 | 5/1979 | Goldsberry et al. | 173/12 |
| 4,191,282 | 3/1980 | Schoeps | 192/0.034 |
| 4,223,745 | 9/1980 | Workman, Jr. | 173/12 |
| 4,265,320 | 5/1981 | Tanaka et al. | 192/0.034 X |

OTHER PUBLICATIONS

Gardner-Denver Company, Pneutronics Division, "Types of Clutches" (2 pages).

Atlas Copco, "Screwdriving—A Question of Technology, Economy and Environment", Clutches for All Types of Work (2 pages).

Dresser, "Dresser Offers Five Types of Production Screwdrivers", pp. 24-27.

Ingersoll-Rand, "Screwdriver Clutch Selection Chart", pp. 10-11.

Stanley, "Selecting Assembly Tools", pp. 10-11.

Desoutter, Clutch Features and Details (one page).

Rockwell, "Rockwell's Patented Torque Control", pp. 54-55.

*Primary Examiner*—Rodney H. Bonck

*Attorney, Agent, or Firm*—Allegretti, Newitt, Witcoff & McAndrews, Ltd.

[57] ABSTRACT

An improved torque control and fluid shutoff mechanism for a fluid operated tool includes an output shaft with an axially slidable cam sleeve mounted on the shaft. The cam sleeve is coupled with a driven tool bit holder to provide a clutch connection. The cam sleeve is biased for engagement with a cam surface on the tool bit holder whereby during normal operation of the tool, the tool bit holder remains fixed relative to the cam sleeve. When a threshold torque acts on the tool bit holder, the tool bit holder rotates relative to the cam sleeve axially driving the cam sleeve to release a biased kickout sleeve from retaining a radially displaceable member. The radially displaceable member engages a throttle rod and a thrust pin. The throttle rod extends to a fluid control valve which controls inlet fluid. Release of the radially displaceable member from being retained by the kickout sleeve permits axial translation of the throttle rod to terminate fluid flow to the motor of the tool. The throttle rod is also responsive through the thrust pin to the position of a tool bit mounted in the tool bit holder to open the fluid flow to the motor.

13 Claims, 4 Drawing Figures

TORQUE CONTROL AND FLUID SHUTOFF MECHANISM FOR A FLUID OPERATED TOOL

BACKGROUND OF THE INVENTION

This invention relates to an improved shutoff mechanism for a torque responsive, fluid operated tool.

Torque producing power tools driven by fluid such as pneumatic power tools are used extensively to attach fasteners and for other operations requiring a rotary shaft output. Many such tools are equipped with a clutch mechanism responsive to the torque imparted by the tool on the fastener. When a specific torque is reached, the clutch mechanism automatically slips and terminates further tool output to the fastener. Other types of tools include torque responsive shutoff mechanisms which shut off the supply of fluid to the tool once a specific torque level has been reached. Shutoff mechanisms help eliminate breakage and wear incurred in clutch control mechanisms. However, the time lag between torque sensing and tool shutoff may result in overtorqueing of the fastener.

Thus, tools have been developed which simultaneously incorporate a clutch mechanism and a power fluid shutoff mechanism to overcome the problems associated with wear of clutches in pure clutch mechanisms and overtorqueing associated with fluid motor shutoff mechanisms. A prior art mechanism of this type is illustrated in DePagter, et al., U.S. Pat. No. 4,078,618, for a "Torque Controller Shutoff Mechanism" issued Mar. 14, 1978.

Numerous additional patents which teach mechanisms for tool shutoff or clutch release upon sensing of appropriate torque levels including the following:

| Reg. No. | Inventor | Title | Issue Date |
|---|---|---|---|
| 2,986,052 | Eckman, et al | Predetermined Torque Responsive Hand Tool | 5/30/61 |
| 3,275,116 | Martin | Air Powered Tool with Overload Cutoff | 9/27/66 |
| 3,288,258 | Taylor | Torque Releasing Clutch Mechanism | 11/29/66 |
| 3,289,715 | De Groff, et al | Automatic Shut-off Tool | 12/6/66 |
| 3,373,824 | Whitehouse | Fluid Operated Tool | 3/19/68 |
| 3,400,633 | Amtsberg, et al | Ultra-Torque Nut Runner with Motor Brake | 9/10/68 |
| 3,407,883 | Amtsberg, et al | Pneumatic Nut-Runner with a Differential Pressure Switch Control | 10/29/68 |
| 3,442,177 | Ulbing, et al | Torque Control System | 5/6/69 |
| 3,473,439 | Bratt | Torque Release Means for Rotary Pneumatic Tools | 10/21/69 |
| 3,498,389 | Tibbott | Automatic Throttle Torque-Responsive Power Tool | 3/3/70 |
| 3,505,928 | Whitehouse | System for Performing Tool Operation and Signaling Completion Thereof | 4/14/70 |
| 3,512,590 | Tibbott | Automatic Throttle Torque-Responsive Power Tool | 5/19/70 |
| 3,512,591 | Kulman | Control for Torque Producing Tool | 5/19/70 |
| 3,515,225 | States | Rotary Impact Tool Having Torque Responsive Disengagement and Power Control | 6/2/70 |
| 3,515,251 | Clapp | Torque Release and Shut-off Device for Rotary Tools | 6/2/70 |
| 3,593,830 | Clapp, et al | Automatic Throttle Torque-Responsive Power Tool | 7/20/71 |
| 3,596,542 | Wallace | Pneumatic Push-Start, Torque Shut-Off Screw Driver | 8/3/71 |
| 3,616,864 | Sorensen, et al | Torque-Controlled Motor Shutoff for Power Tool | 11/2/71 |
| 3,642,039 | McGee | Power Screwdriver | 2/15/72 |
| Re. 27,550 | Bangerter | Torque Release and Shut-off Mechanism for Pneumatic Tools | 1/16/73 |
| 3,766,990 | Eckman, et al | Low Torque Automatic Screwdriver | 10/23/73 |
| 3,811,513 | Wezel et al | Portable Pneumatic Power Tool | 5/21/74 |
| 3,970,151 | Workman, Jr. | Torque Responsive Motor Shutoff for Power Tool | 7/20/76 |
| 4,049,104 | Webb | Power Operated Torque Tool | 9/20/77 |
| 4,071,092 | Wallace | Pneumatic Screwdriver with Torque Responsive Shut-off | 1/31/78 |
| 4,108,252 | Stroezel | Power Driver for Threaded Fasteners | 8/22/78 |
| 4,113,080 | Thackston, et al | Torque Wrench Air Shut-Off | 9/12/78 |
| 4,120,604 | Garofalo | Portable Pneumatic Nut Running Tool Having Air Shut-Off Controls | 10/17/78 |
| 4,154,308 | Goldberry, et al | Low Torque Automatic Screwdriver | 5/15/79 |
| 4,191,282 | Schoeps | Device for Tightening a Screw Joint | 3/4/80 |
| 4,223,745 | Workman, Jr. | Torque Responsive Motor Shutoff Mechanism for Fluid Operated Tool | 9/23/80 |

Of particular pertinence to the present invention are the teachings in U.S. Pat. Nos. 3,811,513; 3,593,830; 3,512,591; 3,512,590; and 3,289,715, as well as the DePagter et al patent referenced above. While each of the prior art references teaches a useful and utilitarian construction, an improved and simplified clutch mechanism and torque responsive shutoff mechanism which also is operative to initiate operation of the tool is desirable.

SUMMARY OF THE INVENTION

Briefly the present invention comprises a fluid powered tool of the type having a fluid driven motor with a rotary output shaft and a clutch mechanism interconnecting the shaft with the tool. Associated with the clutch mechanism is a fluid shutoff control valve device for the motor. The shutoff device includes a drive member axially slidable on the output shaft and keyed to that shaft. Also attached to the shaft is a tool holder which is driven by the drive member. The driven member is rotatable with respect to the shaft but does not slide on the shaft. The driven member and drive member include opposed bearing surfaces which are clutch surfaces inasmuch as the drive member is biased into contact with the driven member. The shaft includes a throughbore into which a throttle rod is positioned for response to axial movement imparted by the tool bit through a thrust pin in combination with radially displaceable members held in position by a sleeve associated with the drive member. The sleeve moves out of the retaining position for the radial members in response to movement of the drive member which occurs whenever a threshold torque is reached causing the drive member to be translated axially against a biasing force.

In operation the tool bit impinges against a thrust pin which, in turn, impinges against radially projecting members that translate the throttle rod in the throughbore to open the fluid control valve to the air motor. The motor then operates through the clutch mechanism described until a threshold torque is reached at which time the clutch members separate permitting the radially movable members to also separate thereby permitting the throttle rod to disengage from the fluid inlet control valve and cause the motor to stop.

Thus, it is an object of the present invention to provide an improved torque responsive, fluid powered tool which terminates torque input to the tool bit upon reaching a threshold torque.

It is also an object of the invention to provide an improved torque responsive, fluid powered tool wherein the tool bit is translated axially in order to initiate operation of the tool.

It is a further object of the present invention to provide an improved torque responsive fluid powered tool wherein the sensing of the threshold torque by a cooperative driven member and drive member also acts to release a fluid inlet control valve to turn off fluid supply to the motor.

A further object of the present invention is to provide a torque responsive, fluid powered tool which automatically terminates operation by terminating fluid flow to the motor associated with the power tool upon reaching a threshold value of torque and which is automatically resettable upon termination of fluid supply to the motor.

Still a further object of the present invention is to provide an improved torque responsive, fluid powered tool having a simplified construction, with a minimum number of parts which is easily repairable and which has a maximum torque.

Another object of the invention is to provide a fluid powered tool having an adjustable clutch.

These and other objects, advantages and features of the invention will be set forth in the detailed description which follows.

BRIEF DESCRIPTION OF THE DRAWING

In the detailed description which follows, reference will be made to the drawing comprised of the following figures.

DESCRIPTION OF THE PREFERRED EMBODIMENT

General Construction

Figure 1:
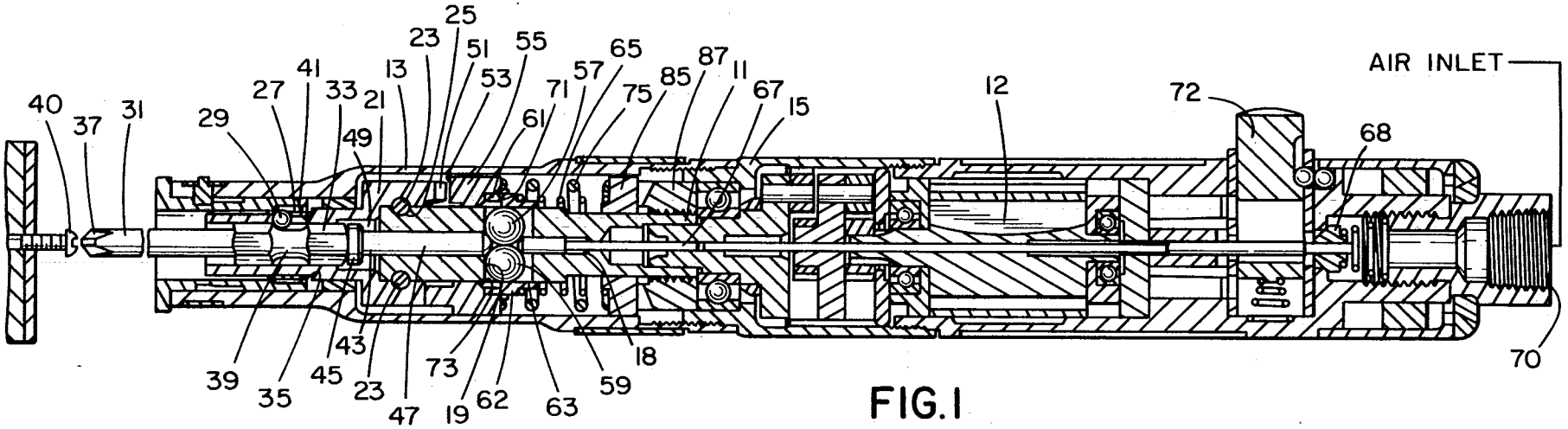
FIG. 1 is a side cross sectional view of the improved torque control and fluid shutoff mechanism associated with an air tool incorporating the present invention in the static condition.
Figure 2:
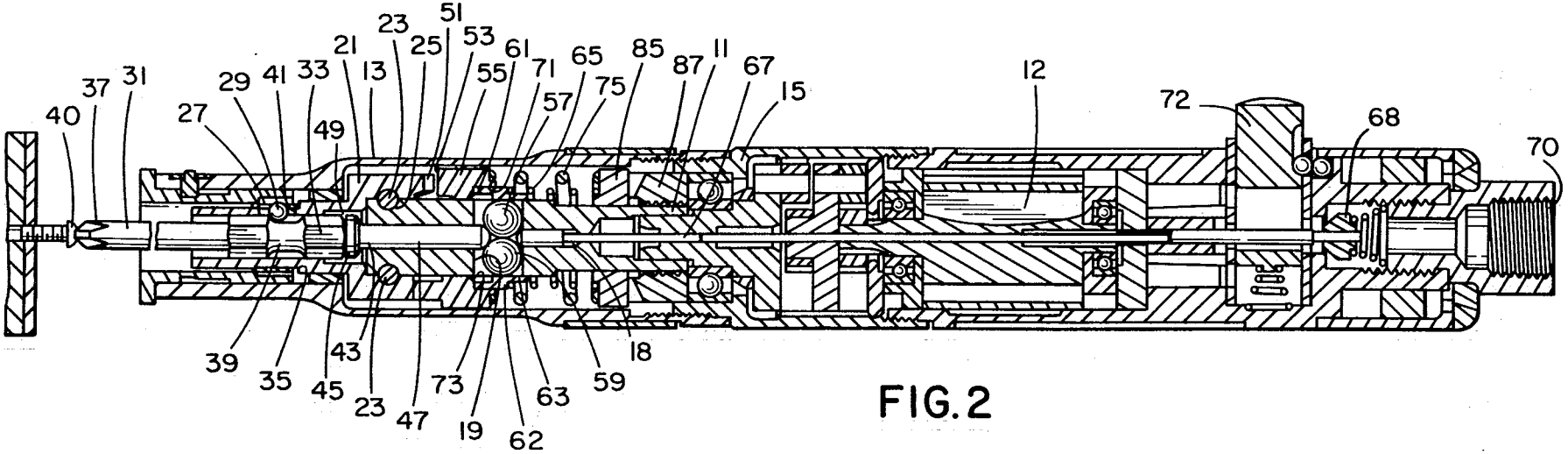
FIG. 2 is a side cross sectional view similar to FIG. 1 wherein the air tool has been initially started by means of axial translation of the tool bit.
Figure 3:
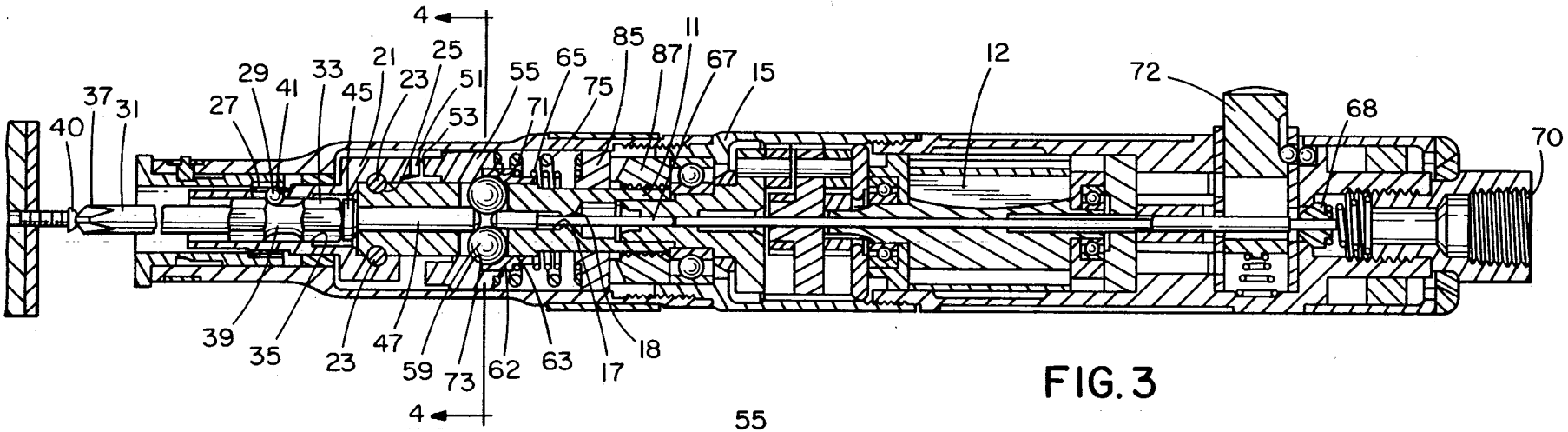
FIG. 3 is a side cross sectional view similar to FIGS. 1 and 2 wherein the air tool has provided maximum torque and has operated the mechanism to shut off fluid flow to the air tool motor.

FIG. 1 is a partial cross sectional view of a pneumatic screwdriver which incorporates the improved torque control and shutoff mechanism of the present invention. FIG. 1 depicts the tool in the static or non-operating condition. FIG. 2 depicts the tool in the operating condition, and FIG. 3 depicts the tool subsequent to maximum torque output.

In FIGS. 1–4, the specific mechanism depicted is the shutoff and torque control mechanism which may be incorporated with the output shaft of any fluid driven tool. The total tool is not depicted inasmuch as the principal aspects of the invention are directed to the torque control and shutoff mechanism which may be combined with any fluid driven tool of the type having a rotary driven, output shaft.

Referring to the figures, the tool includes a clutch spindle or output shaft 11 which may be driven directly or through a gear train by a fluid driven motor, for example, an air motor 12. The shaft or spindle 11 is thus appropriately mounted for rotation in a tool housing 15. The mechanism depicted in FIG. 1 may be protected by a shroud or cover 13 in a manner known to those skilled in the art.

The spindle 11 includes an axial throughbore 17 of varying diameter along its length to receive various component parts to be described. Intermediate the ends of the shaft is a transverse passage 19 which intersects throughbore 17. The throughbore 17 thus extends on opposite sides of the passage 19.

A tool bit holder 21 is coupled with the shaft or spindle 11 by means of a pair of dowel pins 23 which ride in an annular groove 25 defined in the end of the shaft 11. In this manner the shaft 11 may rotate with respect to the tool bit holder 21.

Tool bit holder 21 includes a retaining clip 27 which cooperates with a ball 29 to retain a tool bit 31. In this instance a tool bit 31 with an end blade 37 is provided. The tool bit 31 is keyed by means of its hexagonal body 33 with the complementary passage 35 defined in the end of the bit holder 21. The passage 35, as well as the bit holder 21, are co-axial with the throughbore 17. The tool bit 31 includes an intermediate annular groove 39 in body 33 cooperative with the ball 29. The annular groove 39 is oversized with respect to the diameter of the ball 29 so that the tool bit 31 may translate axially for a distance limited by the cooperative action of the ball 29 with the groove 39 and slot 41 in the tool bit holder 21.

A thrust pin 43 partially extending into throughbore 17 includes a flanged head 45 and an elongated stud section 47. The head 45 is cylindrical in shape and fits within a compatible cylindrical counterbore 49 within the tool bit holder 21. The stud 47 fits within throughbore 17 adjacent the end of shaft 11. The stud 47 as well as the throughbore 17 are of circular cross section.

The bit holder 21 includes an annular cam or bearing surface 51 cooperative with a cam or bearing surface 53 defined on a cam sleeve 55 positioned on the shaft 11 to define a sleeve release mechanism. The cam sleeve 55 has a hexagonal internal cross section 56 complementary for keying with the outer hexagonal cross section 58 of the shaft 11 adjacent the cam sleeve 55. In this manner the cam sleeve which serves as a driver member is rotatable with the shaft 11 and is translatable axially along the shaft 11.

When in static condition illustrated in FIG. 1, the cam surfaces 51, 53 cooperate to lock the driver member 55 to the driven member or tool bit holder 21. In this manner if the shaft 11 is rotated, then the bit holder 21 will simultaneously rotate as a result of being driven by member 55.

The thrust pin 43 and more particularly the stud 47 of the thrust pin 43 is positioned against first and second spherical balls 57, 59 positioned within the transverse passage 19. Each ball 57, 59 has a diameter substantially equal to the radius of the shaft 11 at the passage 19. The balls 57, 59 thus fill the transverse passage 19 along its entire length and are retained in the passage by means of a retaining or kickout sleeve 61.

Figure 4:
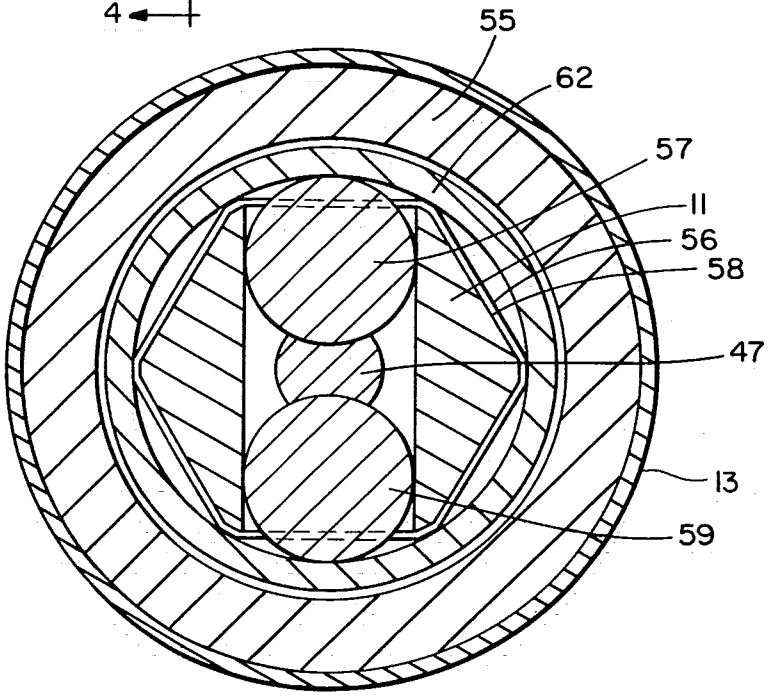
FIG. 4 is a cross sectional view taken substantially along the line 4—4 in FIG. 3.

The kickout sleeve 61 includes a cylindrical counterbore section 62 with an internaldiameter greater than the diameter of shaft 11. The counterbore section 62 transforms smoothly to a slide section 63 having a hexagonal internal shape compatible with the hexagonal section 58 as depicted in FIG. 4. Kickout sleeve 61 is thus axially slidable on shaft 11 with cam sleeve 55 and is retained in position by means of a reset spring 65. The kickout sleeve 61 fits within an annular recess 71 defined around the edge of the cam sleeve 55. Spring 65 biases the sleeve 61 against counterbore surface 73. A second biasing spring 75 biases the cam sleeve 55 so as to cause cam surfaces 51, 53 to engage. The springs 65, 75 are both maintained in compression by an adjustment washer 85 which is adjustably positioned by means of an adjustment nut 87 threaded on the shaft 11. The kickout sleeve 61 is normally biased so that hexagonal slide section 63 retains the balls 57, 59 in position as shown in FIG. 1 in the passage 19. Since annular counterbore section 62 has a diameter greater than the diameter of the shaft 11 when the counterbore section 62 is aligned with the balls 57, 59, the balls 57, 59 may be radially displaceable outward thereby permitting movement either of the stud 57 or of a throttle rod 67 into the passage 19.

Thus, in static condition shown in FIG. 1, the balls 57, 59 are impinged by the stud section 57. The opposite sides of the balls 57, 59 impinge against throttle pin or throttle rod 67 projecting into throughbore 17. The throttle rod 67 extends to a fluid control valve 68 which controls inlet fluid through a fluid inlet 70 and inlet control mechanism 72 to the motor. Moving the rod 67 to the right from the position shown in FIG. 1 will cause the rod 67 to open the fluid control valve 68 and provide fluid to operate and power the motor. When the rod 67 is in the position shown in FIG. 1, the valve is released and terminates flow of fluid to the motor. The rod 67 travels within throughbore 17 which includes a counterbore 18 that limits the amount of travel of the rod 67 to the right in FIG. 1.

Operation

As mentioned previously, FIG. 1 represents the torque control and shutoff mechanism in the static condition prior to use as the fluid powered tool. The rod 67 is thus in a valve off position with the rod 67 retracted to the left in throughbore 17. In order to effect operation of the tool, the tool is placed in the position illustrated by FIG. 2. In this position, the blade 37 of tool bit 31 is inserted into a slot of a fastener 40 and caused to translate axially to the right in FIG. 2 so that the body 33 of the bit impinges against the head 45 of the pin 43. This translates the pin 43 and more particularly the stud 47 against the balls 57, 59 which are retained tightly together by the hexagonal slide section 63 of kickout sleeve 61. The balls 57, 59 then impinge against the throttle rod 67 and drive the rod 67 to the right as shown in FIG. 2 causing the rod 67 to open a fluid control valve 68 to the motor. The motor then begins to operate and drives the shaft 11 and keyed drive member or cam sleeve 55. Sleeve 55 is coupled to tool bit holder 21 and drives holder 21. Tool bit holder 21 is keyed to the tool bit 31 which drives the fastener until a predetermined threshold torque value is reached. This torque value is dependent upon the sum of spring forces or biasing forces due the springs 65, 75. When this threshold torque value is reached, the driving member or cam sleeve 55 will slip over tool bit holder 21 and be moved to the right from the position shown in FIG. 1 due to the interaction of the surfaces 51, 53. That is, the torque load will prevent the tool bit 31 from rotating further. The shaft 11 will, however, continue to rotate relative to the bit holder 21. The sleeve 55 will thus rotate with respect to the tool bit holder 21 causing the cam sleeve 55 to move to the right. The resultant position is depicted in FIG. 3 where the cam sleeve 55 has moved to the right simultaneously driving the kickout sleeve 61 to the right. When this occurs, the balls 57, 59 spread and the stud 47 remains held in position by the tool bit 31. The balls 57, 59 are spread in response to back pressure force through the rod 67 which forces those balls 57, 59 to move into the transverse passage 19. Movement of the rod 67 to the left, as shown in FIG. 3, will release the inlet valve to the air motor thereby shutting off the supply of fluid to the fluid driven motor. When fluid flow is shut off to the motor, the shaft 11 ceases to rotate and no additional torque is placed on the fastener through the tool bit 31.

In order to reset the mechanism, the tool is merely removed from the fastener. This releases the axial force on the bit 31. The bit 31 and pin 43 then move to the left as shown in FIG. 3 to assume the original position shown in FIG. 1. Movement is assisted by virtue of the biasing force associated with the spring 65 which forces the two balls 57, 59 back into passage 19 thereby forcing the stud 47 and thrust pin 43 outwardly. Just after reaching the threshold torque, the cam sleeve 55 is moved by the spring 75 back to its original or reset position shown in FIG. 1.

In this manner then, the tool is reset ready to be restarted by again positioning the tool bit 31. The tool would again continue to operate until a threshold torque is reached at which time the clutch mechanism, namely, the cam sleeve 55 and cooperative tool bit holder 21, interact to terminate driving action between the shaft 11 and the tool bit holder 21 and simultaneously fluid supply is cut off due to the movement of the throttle rod 67. Thus, there has been presented a simplified mechanism which provides for automatic starting and stopping of a rotary air tool as well as declutching of that tool upon reaching a threshold torque value. While there has been presented a preferred embodiment of the invention, it is to be understood that the invention is to be limited only by the following claims and their equivalents.

What is claimed is:

1. In a fluid power tool of the type including a fluid driven motor with a rotary output shaft, a fluid inlet to the motor, an inlet control mechanism to control fluid flow to the motor, and a clutch mechanism, connecting the output shaft with a tool bit, the improvement comprising, in combination:

a fluid shutoff mechanism associated with the clutch mechanism, said fluid shutoff mechanism including a throughbore axially extending through the shaft; a throttle rod in the throughbore translatable in one axial direction to terminate fluid flow through the fluid inlet to the motor and in the opposite axial direction to allow fluid flow to the motor;

a passage in the shaft transverse to the throughbore intermediate the ends of the throughbore and adjacent an end of the throttle rod positioned in the throughbore;

at least one radially displaceable member positioned in the transverse passage for engagement with the throttle rod;

a slidable kickout sleeve on the shaft for retaining the radially displaceable member positioned in the passage for engaging the throttle rod;

means biasing the slidable kickout sleeve to the position for retaining the radially displaceable member to engage the throttle rod;

a thrust pin coaxial with the throttle rod and in the throughbore on the opposite side of the transverse passage from the throttle rod, said thrust pin engageable with the tool bit and translatable against the radially displaceable member to drive the throttle rod to open fluid flow through the fluid inlet; and a torque responsive sleeve release mechanism on the shaft slidable axially to release the slidable kickout sleeve from retaining the radially displaceable member, said radially displaceable member movable in the passage to permit axial translation of the throttle rod to terminate fluid flow to the fluid inlet, said sleeve release mechanism including a tool bit holder mounted on the shaft and rotatable with respect thereto, and a cam sleeve slidably mounted on the shaft for axial movement, said cam sleeve biased for engagement with a cam surface on the tool bit holder whereby during normal operation of the tool, the tool bit holder remains fixed relative to the cam sleeve, said tool bit holder rotating relative to said cam sleeve to axially drive the cam sleeve when a threshold torque acts on the tool bit holder.

2. The improvement of claim 1 wherein the tool bit holder includes a throughbore axially aligned with the shaft throughbore, and wherein the tool bit is retained in the tool bit holder throughbore for limited axial movement to drive the thrust pin.

3. The improvement of claim 1 wherein the cam sleeve and slidable kickout sleeve are each biased by a coil spring concentric with the shaft and retained by a single engagement flange on the shaft.

4. The improvement of claim 3 therein the flange is defined by an adjustably positioned washer to control the biasing force on the cam sleeve and slidable kickout sleeve and thereby the torque response of the tool.

5. The improvement of claim 1 wherein the cam sleeve and slidable kickout sleeve comprise annular concentric members on the shaft biased by concentric coil springs.

6. The improvement of claim 1 wherein the cam sleeve comprises an annular member concentrically mounted on the shaft, said member including an annular cam surface and said tool bit holder also includes an annular cam surface cooperative with the annular member cam surface in response to torque.

7. The improvement of claim 1 wherein the radially displaceable member comprises first and second balls in the transverse passage, each ball having a diameter substantially equal to the radius of the shaft.

8. The improvement of claim 1 wherein the cam sleeve is keyed to the shaft.

9. The improvement of claim 1 wherein the tool bit is keyed to the tool bit holder.

10. The improvement of claim 1 wherein the slidable kickout sleeve is keyed to the shaft.

11. A fluid powered tool comprising, in combination:

a fluid driven motor with a rotary output shaft;

a fluid inlet to the motor;

a fluid control valve;

a tool bit holder coupled to the shaft and rotatable relative to the shaft as a driven member;

a tool bit axially slidable in the tool bit holder;

a driver member coupled to the shaft and axially slidable thereon, said driver member coaxially rotatable with and relative to the tool bit holder;

a coaxial throughbore in the shaft and tool bit holder;

a throttle rod axially movable in the throughbore for operating the fluid control valve;

a thrust pin in the throughbore responsive to axial movement of the tool bit in the tool bit holder;

radially movable members in the shaft projecting into the throughbore intermediate the thrust pin and throttle rod, said radially movable members positioned for engaging the thrust pin and throttle rod; and means for releasing the radially movable members from projecting into the throughbore in response to a threshold torque.

12. The tool of claim 11 wherein the means for releasing include an annular kickout sleeve keyed to the shaft and axially slidable thereon to retain and release the radially movable members.

13. The tool of claim 12 wherein the annular kickout sleeve is connected to and movable in response to axial movement of the driver member upon reaching a threshold torque.

* * * * *